US005488892A

United States Patent [19]

Jepsen

[11] Patent Number: 5,488,892

[45] Date of Patent: Feb. 6, 1996

[54] PICK HOLDER

[76] Inventor: James Jepsen, 6120-A Elmer Der Rd., Frederick, Md. 21701

[21] Appl. No.: 393,998

[22] Filed: Feb. 24, 1995

Related U.S. Application Data

[63] Continuation-in-part of Ser. No. 270,530, Jul. 5, 1994, abandoned, which is a continuation-in-part of Ser. No. 583,687, Sep. 17, 1990, abandoned.

[51] Int. Cl.[6] ..... G10D 3/16

[52] U.S. Cl. ..... 84/322; D17/22

[58] Field of Search ..... 84/329, 322, 453; D17/22

[56] References Cited

U.S. PATENT DOCUMENTS 4,135,431 1/1979 Ferguson ..... 84/329
4,785,708 11/1988 Vaughan ..... 84/329

*Primary Examiner*—Cassandra C. Spyrou

*Attorney, Agent, or Firm*—Levy, Zito & Grandinetti

[57] ABSTRACT

A pick holder is adapted for temporary storage and protection of a musical pick that is used for plucking strings of a stringed musical instrument such as a guitar. The pick holder comprises a flat body structure that includes a pair of side panels of identical configuration. Each of the side panels has an outer surface and an opposite parallel inner surface with a peripheral margin extending around the inner surface. The peripheral margin has a connecting peripheral margin portion and a free peripheral margin portion whereby the side panels are connected in a facial relationship at respective ones of the connecting peripheral margin portions to form an interior compartment between the inner surfaces of the side panels. Respective ones of the free peripheral margin portions define an opening into the interior compartment. The interior compartment and the opening are sized and adapted to slidably receive the pick so that the pick can slide through the opening and into the interior compartment to be releasably retained for temporary storage and protection therein and can be slidably removed from the interior compartment and through the opening when use of the pick is desired.

5 Claims, 4 Drawing Sheets

PICK HOLDER

REFERENCES TO RELATED APPLICATION present patent application is a continuation in part of patent application bearing Ser. No. 08/270,530 filed Jul. 5, 1994, now abandoned which was a continuation in part of patent application bearing Ser. No. 07/583,687 filed Sep. 17, 1990, and now abandoned.

FIELD OF THE INVENTION

The present invention relates to a pick holder which is adapted for temporary storage and protection of a musical pick used for plucking strings of a stringed musical instrument.

BACKGROUND OF THE INVENTION

As well known in the art, it is common for a musician to require easy access to one or more different picks while performing on a stringed musical instrument. A number of pick holders are known, such as those taught in Ferguson U.S. Pat. No. 4,135,431; Vaughan U.S. Pat. No. 4,785,708; Phillips U.S. Pat. No. 3,181,410 and Ashe-Browne GB 2,208,255. Phillips teaches a magnetic device for securing a single, specially-constructed pick. Ferguson teaches a dispenser for holding a number of picks and dispensing them one at a time according to their order of insertion. Vaughn teaches a flexible strip mounted to an instrument body and having a plurality of pockets for holding a variety of picks.

SUMMARY OF THE INVENTION

It is an object of the present invention to provide a pick holder of simple construction to store and protect one or a plurality of picks.

It is another object of the present invention to provide a pick holder with a plurality of interior compartments for independent storage of a plurality of picks and for easy selection of the plurality of picks.

It is yet another object of the present invention to provide a pick holder with sufficient structural rigidity to protect the picks from damage during storage.

It is a further object of the present invention to provide a pick holder which isolates each pick for independent retention and selection.

It is still a further object of the present invention to provide a pick holder having a retaining element for retaining the pick within the interior compartment of the pick holder.

Accordingly, a pick holder of the present invention is adapted for temporary storage and protection of a musical pick that is used for plucking strings of a stringed musical instrument such as a guitar. In its broadest form, the pick holder of the present invention comprises a flat body structure that includes a pair of side panels of identical configuration. Each of the side panels has an outer surface and an opposite parallel inner surface with a peripheral margin extending around the inner surface. The peripheral margin has a connecting peripheral margin portion and a free peripheral margin portion whereby the side panels are connected in a facial relationship at respective ones of the connecting peripheral margin portions to form an interior compartment between the inner surfaces of the side panels. Respective ones of the free peripheral margin portions define an opening into the interior compartment. The interior compartment and the opening are sized and adapted to slidably receive the pick so that the pick can slide through the opening and into the interior compartment to be releasably retained for temporary storage and protection therein and can be slidably removed from the interior compartment and through the opening when use of the pick is desired.

If desired, an adhesive element can be attached to one or both of the outer surfaces of the side panels. The adhesive element is used to mount the body structure onto the stringed musical instrument or can be used to connected a plurality of body structures together to form a pick holder for temporarily storing and protecting a plurality of picks. Also, if desired, a retainer element or a pair of retainer elements can be mounted to the inner surface of the side panels to releasably retain the pick within the interior compartment of the body structure.

These and other objects of the present invention will become more readily appreciated and understood from consideration of the following detailed description of the exemplary embodiments of the present invention when taken in conjunction with the accompanying drawings, in which:

DETAILED DESCRIPTION OF THE EMBODIMENTS

Figure 5:
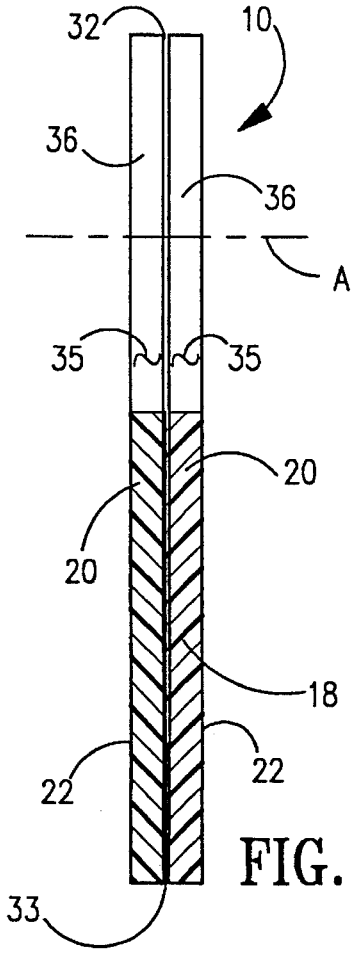
FIG. 5 is a side view in cross-section of the pick holder of the present invention taken along line 5—5 in FIG. 4.
Figure 6:
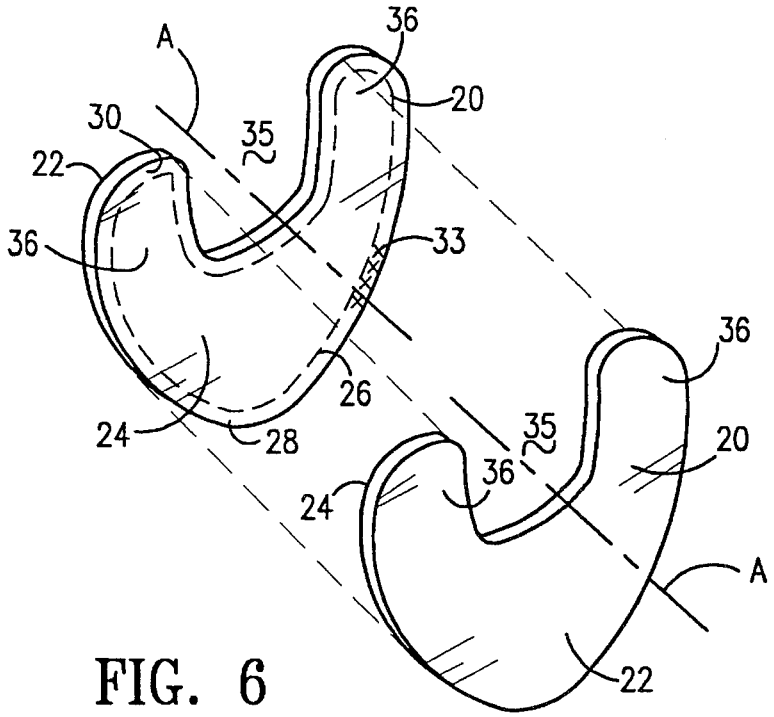
FIG. 6 is an exploded perspective view of the pick holder of the present invention showing a pair of side panels having identical configurations.
Figure 7:
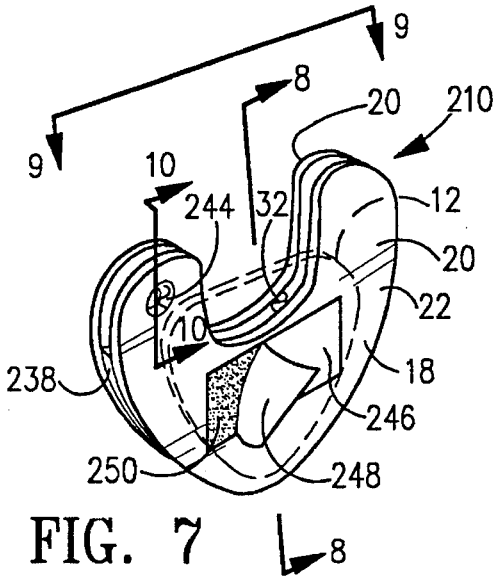
FIG. 7 is a perspective view of a second exemplary embodiment of a pick holder of the present invention shown with a spacer, a retainer element and an adhesive element.

A first exemplary embodiment of a pick holder 10 of the present invention is generally introduced in FIGS. 1–6. Pick holder 10 is adapted for temporary storage and protection of a musical pick 12 used for plucking strings 14 of a stringed musical instrument 16 which, by way of example only, is a guitar. Pick holder 10 comprises a flat body structure 18 which includes a pair of side panels 20. Body structure 18 is preferably fabricated from a stiff yet resilient material such as plastic. Side panels 20 are of identical configuration relative to one another. Each of side panels 20 has an outer surface 22 and an opposite parallel inner surface 24. Both outer surface 22 and inner surface 24 are preferably flat. As best shown in FIG. 6, each of side panels 20 also has a peripheral margin 26 illustrated by the dashed lines which extends therearound. Peripheral margin 26 has a connecting peripheral margin portion 28 and a free peripheral margin portion 30. Connecting peripheral margin portion 28 is located along inner surface 24 at approximately a lower one-half portion of side panels 20 and forms a U-shaped configuration. Free peripheral margin portion 30 is located approximately at an upper one-half portion of side panels 20 and forms a serpentine configuration.

Figure 2:
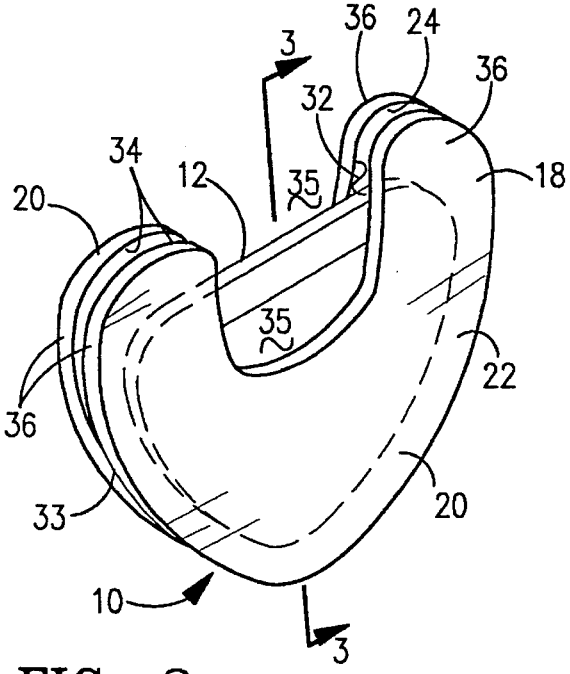
FIG. 2 is a perspective view of the pick holder of the present invention of FIG. 1 shown in an opened state with a pick retained therein.
Figure 4:
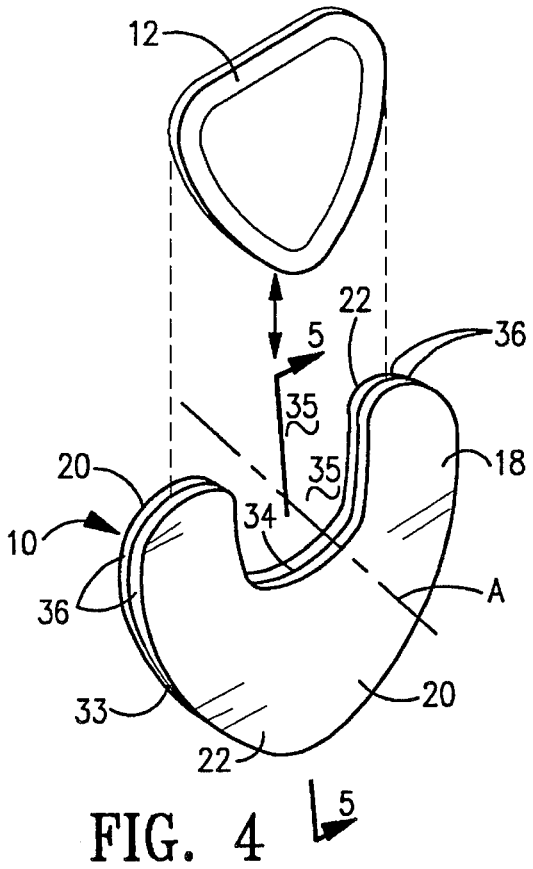
FIG. 4 is a perspective view of the pick holder of the present invention shown in a normally closed state with the pick removed therefrom.

Side panels 20 are connected in a facial relationship at respective ones of connecting peripheral margin portions 28 to form an interior compartment 32 between inner surfaces 24 of side panels 20. Although not by way of limitation, it is preferred that an adhesive substance 33 is applied to connecting peripheral margin portions 28 in order to connect side panels 20 together. Respective ones of free peripheral margin portions 30 define an opening 34 into interior compartment 32. With reference to FIGS. 2 and 4, interior compartment 32 and opening 34 are sized and adapted to slidably receive pick 12 so that pick 12 can slide through opening 34 and into interior compartment 32 in order to be releasably retained for temporary storage and protection therein. Also, interior compartment 32 and opening 34 are sized and adapted to slidably receive pick 12 so that pick 12 can be slidably removed from interior compartment 32 and through opening 34 when use of pick 12 is desired.

Figure 3:
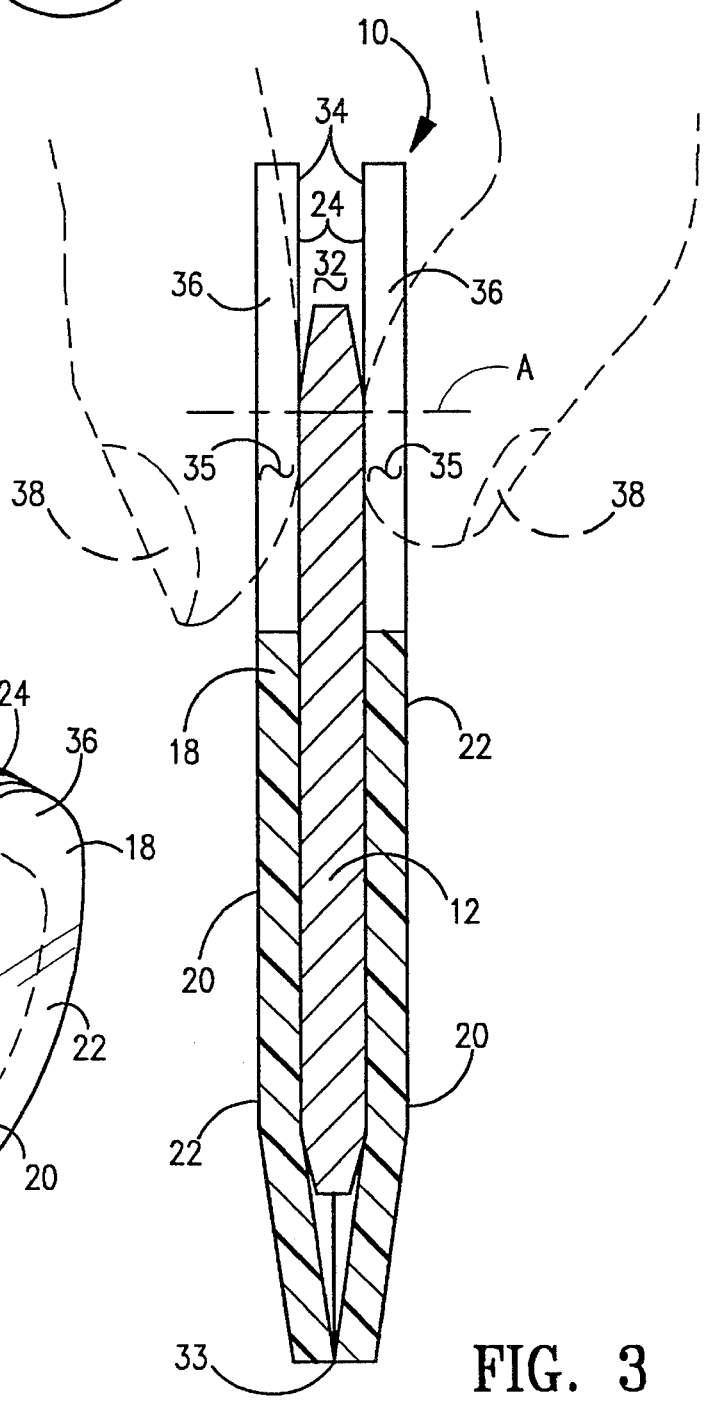
FIG. 3 is a side view in cross-section of the pick holder of the present invention taken along line 3—3 in FIG. 2.

For the first exemplary embodiment of pick holder 10 of the present invention, side panels 20 are operative to move between a normally closed state, as shown in FIGS. 4 and 5, and an opened state, as shown in FIGS. 2 and 3. In the normally closed state, inner surfaces 24 are in facial contact with each other when pick 12 is removed from interior compartment 32. In the opened state, side panels 20, which are resiliently biased toward the normally closed state, move apart from one another so that inner surfaces 24 contact pick 12 when pick 12 is disposed within interior compartment 32 thereby retaining pick 12 therein.

Each of side panels 20 includes a channel 35 that extends therethough and about a central axis "A" to form a pair of oppositely disposed lobes 36. When side panels 20 are connected to each other in a facial relationship, respective ones of central axes "A" are coextensively aligned so that respective channels 35 and respective pairs of lobes 36 are also in facial registration with one another. In general, lobes 36 constitute the upper one-half portion of respective ones of side panels 20. For the first exemplary embodiment of pick holder 10 of the present invention, channel 35 is configured in a U-shape. As best shown in FIG. 3, channel 35 is sized and adapted so that a user can insert at least a finger 38, drawn in phantom, into one of channels 35 between a respective one of the pairs of lobes 36 in order to maintain contact with pick 12 when storing pick 12 into interior compartment 32 of body structure 18 and removing pick 12 from interior compartment 32 of body structure 18. Particularly, FIG. 3 illustrates the user inserting two fingers 38, i.e. a finger and a thumb, into respective ones of channels 35 to maintain contact with and to grip pick 12 for storage into and removal from interior compartment 32.

Figure 8:
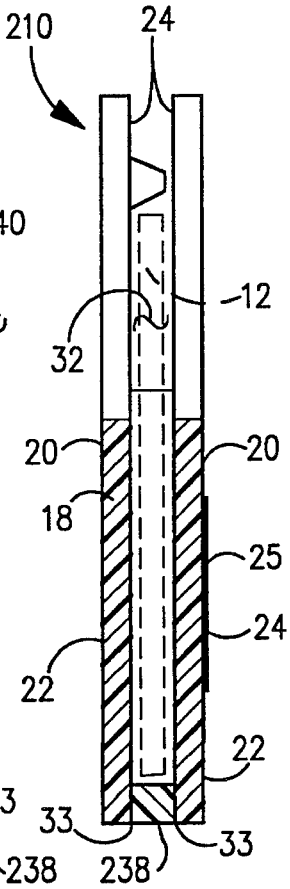
FIG. 8 is a side view in cross-section of the pick holder of the present invention taken along line 8—8 in FIG. 7.
Figure 9:
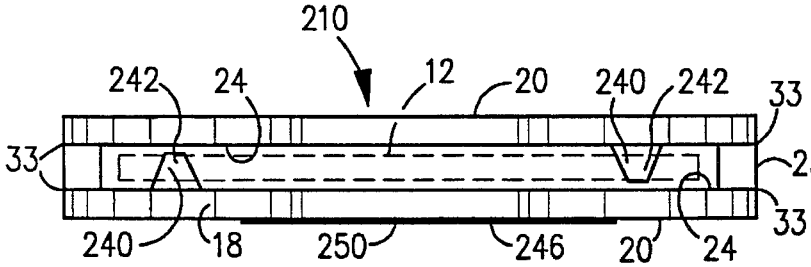
FIG. 9 is a top plan view of the pick holder of the present invention taken along line 9—9 in FIG. 7.
Figure 11:
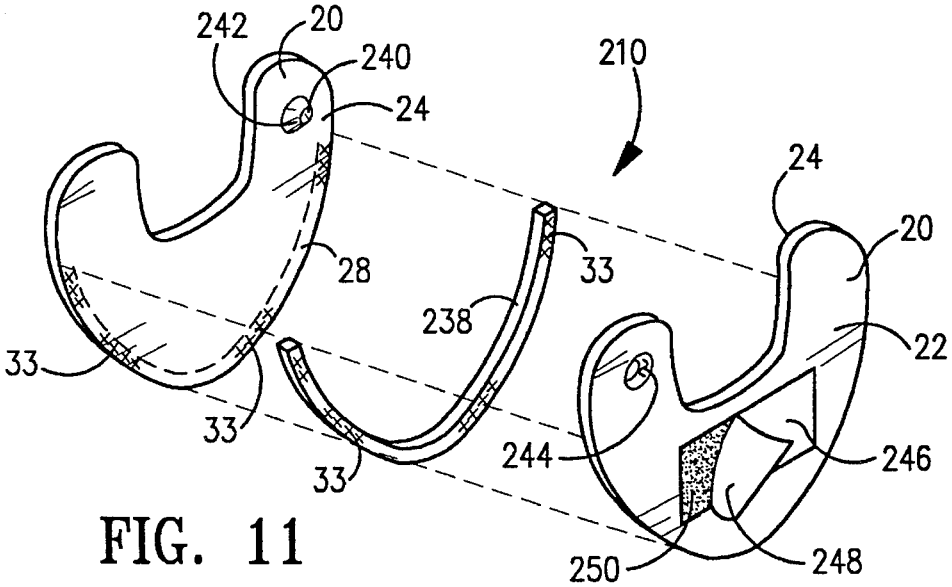
FIG. 11 is an exploded perspective view of the pick holder of the present invention of FIG. 7 showing a pair of side panels spaced apart from one another with the spacer disposed therebetween.

A second exemplary embodiment of a pick holder 210 is introduced in FIGS. 7–11. Pick holder 210 is similar to the one described hereinabove. However, pick holder 210 includes a spacer 238 which is interposed between and operative to interconnect respective ones of connecting peripheral margin portions 28 of inner surfaces 24 of side panels 20. In FIG. 8, adhesive substance 33 is employed to interconnect spacer 238 with connecting peripheral margin portions 28. With each of connecting peripheral margin portions 28 configured in the U-shape configuration, likewise, spacer 238 is configured in a U-shaped configuration. The U-shaped configurations of each connecting peripheral margin portion 28 are sized and adapted to register with spacer 238.

Figure 10:
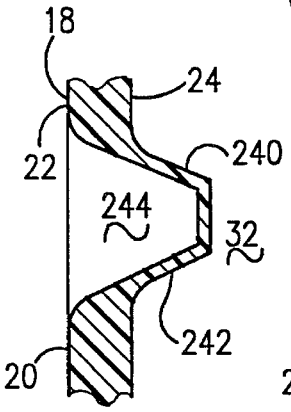
FIG. 10 is an enlarged side view in cross-section of the retainer element taken along line 10—10 in FIG. 7.

Pick holder 210 of the present invention also includes a pair of retaining elements 240. The pair of retaining elements 240 are disposed within interior compartment 32 of body structure 18 and are operative to releasably retain pick 12, drawn in phantom, within interior compartment 32 when pick 12 is stored therein. One of ordinary skill in the art would appreciate that a single retaining element 240 would be adequate for retaining pick 12 within interior compartment 12. For purposes of the second exemplary embodiment of pick holder 210 of the present invention, each retaining element 240 includes a protrusion 242 that projects from a respective one of inner surfaces 24 and into interior compartment 32. A skilled artisan would comprehend that if only one retainer element 240 is employed then such retainer element 240 would project from only one of inner surfaces 24 and into interior compartment 32. Again, for purposes of the second exemplary embodiment of pick holder 210 of the present invention, each of retaining element 240 includes a corresponding indentation 244 formed on an opposite side of protrusion 242 as best shown in FIG. 10. Indentation 244 extends from outer surface 22 of side panel 20 and toward interior compartment 32 of body structure 18. Protrusion 242 with indentation 244 is formed as a unitary construction with respective ones of side panels 20. Note that both side panels 20 are of identical configuration. The reason that both protrusions 242 project into interior compartment 32 is that one side panel 20 is flip-flopped relative to the other one. Such a feature reduces manufacturing costs because only one side panel 20 needs to be fabricated.

Other types of retainer elements 240 can be used in lieu of the protrusion with its corresponding indentation. Such retainer elements include a rubber element or rubber elements that could be glued to inner surface 24. A spring member could also be mounted to inner surface 24 to resiliently bias pick 12 to retain it within interior compartment 32. Since one of ordinary skill in the art would appreciate the features and benefits of these alternate retainer elements, no further discussion is deemed necessary.

Figure 1:
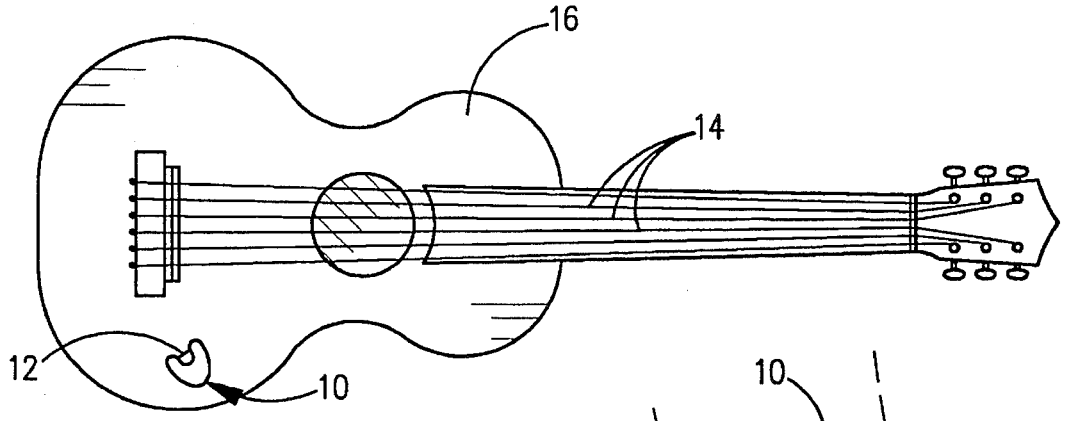
FIG. 1 is a side view in elevation of a first exemplary embodiment of a pick holder of the present invention mounted to a musical stringed instrument such a guitar with a musical pick disposed in an interior compartment of the pick holder.

Further, pick holder 210 of the present invention includes an adhesive element 246 which is mounted on outer surface 22 of at least one of the pair of side panels 20. Although not by way of limitation, adhesive element 246 is a common two-sided adhesive tape with one side adhering to outer surface 22 and the other side covered by a sheet material 248. Adhesive element 246 includes an adhesive material 250 which is operative to adhere body structure 18 onto stringed musical instrument 16 as shown in FIG. 1. If it is desired that pick holder 210 of the present invention should not be adhered to stringed musical instrument 16, then sheet material 248 shall remain on adhesive element 246 to cover adhesive material 250. With sheet material 248 covering adhesive material 250 of adhesive element 246, the user can, for example, store pick 12 into pick holder 210 and place the same in his/her pocket.

Figure 12:
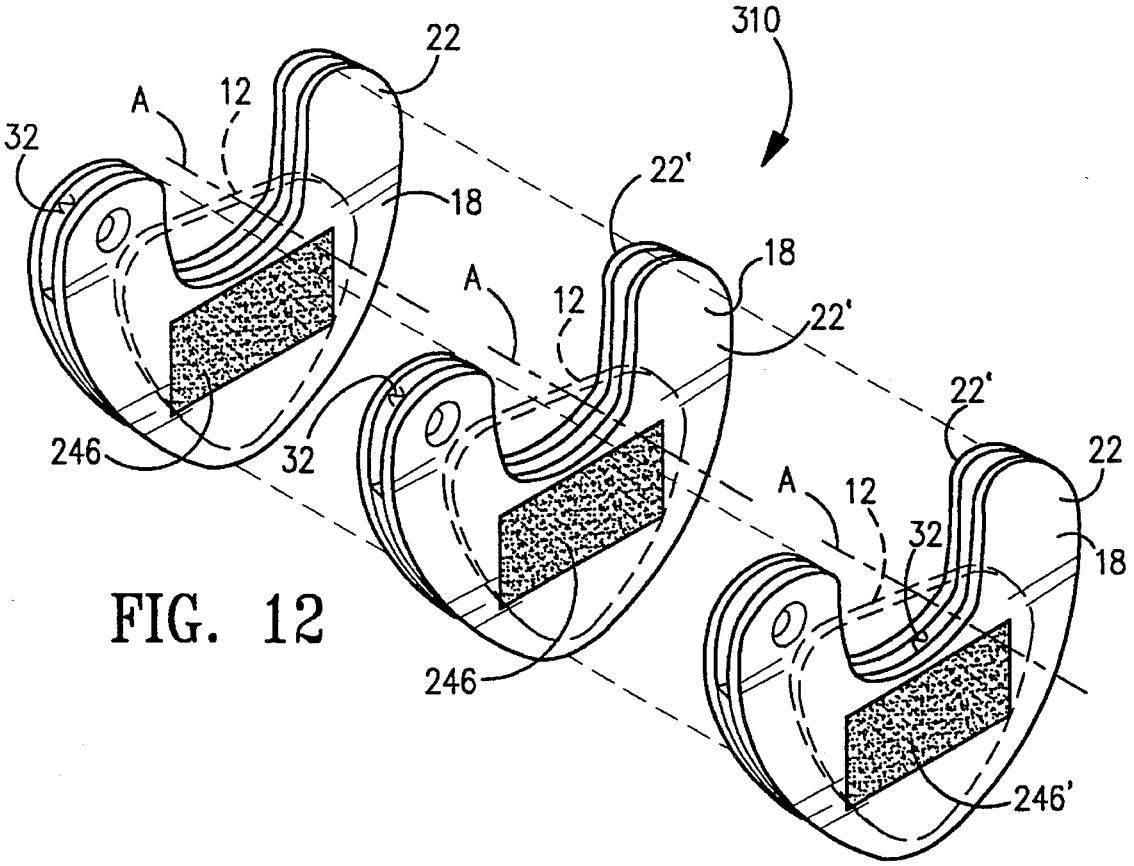
FIG. 12 is an exploded perspective view of a third exemplary embodiment of a pick holder of the present invention showing a plurality of body structures with adhesive elements.
Figure 13:
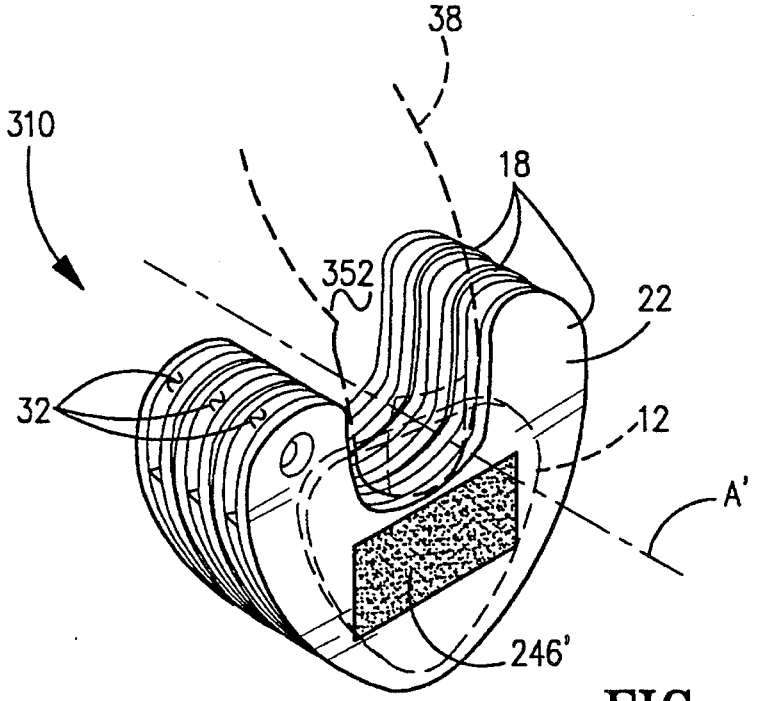
FIG. 13 is a perspective view of the third exemplary embodiment of the pick holder of the present invention with a phantomly drawn pick disposed therein with a user's finger, also phantomly drawn, in contact with the pick.

A third exemplary embodiment of a pick holder 310 of the present invention is shown in FIGS. 12 and 13. Pick holder 310 of the present invention is adapted for temporary storage and protection of a plurality of musical picks 12. Pick holder 310 comprises a plurality of flat body structures 18 as hereinabove described and at least one adhesive element 246. One adhesive element 246 is disposed between consecutive ones of body structures 18 and is operative to adhere facially opposing outer surfaces 22' of consecutive ones of body structures 18 to form pick holder 310. When body structures 18 are adhered together, central axes "A" are aligned coextensively with one another to form an elongated U-shaped channel 352 which extends about elongated central axis "A'". Elongated U-shaped channel 352 is sized and adapted so that a user can insert at least one finger 38 thereinto in order to maintain contact with one of the plurality of picks 12 when storing pick 12 into a select one of interior compartments 32 and removing pick 12 from a select one of interior compartments 32 of body structure 18.

Although not by way of limitation, an additional adhesive element, referred to as a mounting adhesive element 246', is connected to an end one of body structures 18 on an outer surface 22 thereof. Mounting adhesive element 246' is operative to removably adhere pick holder 310 onto stringed musical instrument 16, if desired, or some other flat support surface, if desired. Otherwise, pick holder 310 can, for example, be placed in the user's pocket or be attached to a continuous cord or chain to facilitate carrying the same. The user could then carry pick holder 310 around his/her neck.

It is appreciated that the pick holder of the present invention is of simple construction and can easily store and protect either one or a plurality of musical picks. For added protection, the pick holder having a plurality of interior compartments provides for independent storage of each of the picks and provides easy selection of any select one the picks. This pick holder also isolates each pick for independent retention and selection. The pick holder has sufficient structural rigidity to protect the picks from damage during storage. Furthermore, the retainer element retains respective ones of the picks within respective ones of the interior compartments of the pick holder.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A pick holder adapted for temporary storage and protection of a musical pick used for plucking strings of a stringed musical instrument, comprising:

(a) a flat body structure including a pair of side panels of identical configuration, each of said side panels having an outer surface and an opposite parallel inner surface with a peripheral margin extending around said inner surface, said peripheral margin having a connecting peripheral margin portion and a free peripheral margin portion, said side panels connected in a facial relationship at respective ones of said connecting peripheral margin portions to form an interior compartment between said inner surfaces of said side panels with respective ones of said free peripheral margin portions defining an opening into said interior compartment, said interior compartment and said opening sized and adapted to slidably receive the pick so that the pick can slide through said opening and into said interior compartment to be releasably retained for temporary storage and protection therein and can be slidably removed from said interior compartment and through said opening when use of the pick is desired; and (b) a retaining element disposed within said interior compartment of said body structure and operative to releasably retain the pick within said interior compartment when the pick is stored therein, said retaining element including a protrusion projecting from one of said inner surfaces and into said interior compartment and including a corresponding indentation formed on an opposite side of said protrusion, said indentation extending from said outer surface of said side panel and toward said interior compartment of said body structure member.

2. A pick holder adapted for temporary storage and protection of a plurality of musical picks, a select one of the plurality of musical picks being used for plucking strings of stringed musical instruments, comprising:

(a) a plurality of flat body structures, each said body structure including a pair of side panels of identical configuration, each of said side panels having an outer surface and an opposite parallel inner surface with a peripheral margin extending around said inner surface, said peripheral margin having a connecting peripheral margin portion and a free peripheral margin portion, said side panels connected in a facial relationship at respective ones of said connecting peripheral margin portions to form an interior compartment between said inner surfaces of said side panels with respective ones of said free peripheral margins defining an opening into said interior compartment, said interior compartment and said opening sized and adapted to slidably receive a respective one of the picks so that the respective one of the picks can slide through a respective one of said openings and be releasably retained in a respective one of said interior compartments for temporary storage and protection therein and can be slidably removed from the respective one of said interior compartments and through said openings when use of a selected one of the picks is desired, each of said body structures having at least one of said outer surfaces facially opposing one of said outer surfaces of a consecutive one of said body structures; and (b) an adhesive element disposed between facially opposing ones of said outer surfaces to form said pick holder adapted for storing and protecting the plurality of picks whereby each of said side panels includes a channel extending therethough and about a central axis to form a pair of oppositely disposed lobes so that when said body structures are adhered together said central axes are aligned coextensively with one another to form an elongated U-shaped channel, said elongated U-shaped channel being sized and adapted so that a user can insert a finger thereinto in order to maintain contact with one of the plurality of picks when storing said one of the plurality of picks into a select one of said interior compartments and removing said one of the plurality of picks from a select one of said interior compartments of said body structure.

3. A pick holder according to claim 2 including a retaining element disposed within said interior compartment of each of said body structures and operative to releasably retain respective ones of the plurality of the picks within respective ones of said interior compartments when the picks are stored therein, said retaining element including a protrusion protecting from one of said inner surfaces and into said interior compartment and formed with a corresponding indentation disposed opposite of said protrusion and extending from said outer surface of said side panel and toward said inner surface of said side panel.

4. A pick holder adapted for temporary storage and protection of a musical pick used for plucking strings of a stringed musical instrument, comprising:

a flat body structure including a pair of side panels of identical configuration, each of said side panels having an outer surface and an opposite parallel inner surface with a peripheral margin extending around said inner surface, said peripheral margin having a connecting peripheral margin portion and a free peripheral margin portion, said side panels connected in a facial relationship at respective ones of said connecting peripheral margin portions to form an interior compartment between said inner surfaces of said side panels with respective ones of said free peripheral margin portions defining an opening into said interior compartment, said interior compartment and said opening sized and adapted to slidably receive the pick so that the pick can slide through said opening and into said interior compartment to be releasably retained for temporary storage and protection therein and can be slidably removed from said interior compartment and through said opening when use of the pick is desired, each of said side panels including a channel extending therethough about a central axis to form a pair of oppositely disposed lobes, said channel being sized and adapted so that a user can insert a finger into one of said channels between a respective one of said pair of lobes in order to maintain contact with the pick when storing the pick into said interior compartment of said body structure and removing the pick from said interior compartment of said body structure.

5. A pick holder according to claim 4 wherein said channel is configured in a U-shape.

* * * * *